United States Patent [19]

Wiechert et al.

[11] Patent Number: 4,563,956

[45] Date of Patent: Jan. 14, 1986

[54] TRAVELLING MECHANISM OF A TRANSPORT CAR RUNNING ON PROFILE RAIL TRACK

[75] Inventors: Edelbert Wiechert; Herbert Lehmann, both of Berlin, Fed. Rep. of Germany

[73] Assignee: Siemens Aktiengesellschaft, Berlin and Munich, Fed. Rep. of Germany

[21] Appl. No.: 555,160

[22] Filed: Nov. 25, 1983

[30] Foreign Application Priority Data

Nov. 25, 1982 [DE] Fed. Rep. of Germany ..... 3243914

[51] Int. Cl.[4] ..... B61C 11/00

[52] U.S. Cl. ..... 105/29 R; 104/88; 295/31 R

[58] Field of Search ..... 105/29 R; 104/88, 1 A; 295/4, 5, 31 R, 33, 34

[56] References Cited

U.S. PATENT DOCUMENTS

| | | | |
|---|---|---|---|
| 3,340,821 | 9/1967 | Wesener | 104/88 |
| 3,922,970 | 12/1975 | Glastra | 105/29 R |
| 4,262,599 | 4/1981 | Ahr | 104/88 |

FOREIGN PATENT DOCUMENTS

| | | | |
|---|---|---|---|
| 663134 | 7/1938 | Fed. Rep. of Germany | 104/1 A |
| 750327 | 8/1933 | France | 295/31 |
| 429888 | 6/1935 | United Kingdom | 295/31 R |

*Primary Examiner*—Harry Tanner

*Attorney, Agent, or Firm*—Hill, Van Santen, Steadman & Simpson

[57] ABSTRACT

A frictional wheel and a toothed wheel with a pitch diameter less than the diameter of the frictional wheel are secured to a drive shaft of the travelling mechanism. The frictional wheel is comprised of an elastic material and exhibits radial slots for the elastic compensation of the slip caused by the different diameters.

5 Claims, 4 Drawing Figures

TRAVELLING MECHANISM OF A TRANSPORT CAR RUNNING ON PROFILE RAIL TRACK

BACKGROUND OF THE INVENTION

The invention relates to a travelling mechanism of a transport car for transporting files, and/or transport goods having similar dimensions or, respectively, similar weight, and running on horizontal and, in sections, vertical profile rail track and comprising a drive shaft coupled to an electric motor, said drive shaft carrying, in addition to a frictional drive wheel, a toothed drive wheel for rolling engagement with a toothed rack in the vertical profile rail tracks and having a pitch diameter dimensioned lower than the diameter of the frictional drive wheel.

In comparison to travelling mechanisms wherein the diameter of the frictional drive wheel and the pitch diameter of the toothed drive wheel are of at least approximately the same size, such a travelling mechanism exhibits the advantage of a better exploitation of the motor output because a higher travel speed can be achieved on the horizontal profile rail tracks than in the area of the vertical profile rail tracks. This advantage is achieved in a known electric transport rail system in that the frictional drive wheel is lifted off from its running rail in those areas of the profile rail track provided with a toothed rack. The toothed drive wheel thus runs in the toothed rack without play, this being necessarily connected with an increased wear of the toothed drive wheel and an increase in running noise.

This disadvantage is avoided in a transport rail system known from the German OS No. 25 45 907 having a transport car running on a rail in that the travelling mechanism of the transport car exhibits one or more auxiliary wheels mounted freely rotatable around its axle and in that auxiliary running surfaces are disposed at the rail in front of the area of toothed racks, the auxiliary wheels running up onto said auxiliary running surfaces and lifting the frictional drive wheel up from its running surface. This development of a transport rail system and of the transport car running on the transport rail system thus requires the application of an additional wheel to the travelling mechanism and of an additional running surface to a profile rail. This additional outlay and, in particular, the space requirement for the further wheel thereby induced is to be viewed as a serious disadvantage for the profile rails of conveyor systems for transporting files and/or transport goods having similar dimensions or, respectively, similar weight since as small as possible a space requirement for the profile rail tracks and the smallest possible dimensions and low weight of the travelling mechanism are a desired goal in such conveyor systems.

SUMMARY OF THE INVENTION

The object underlying the invention, namely better exploitation of the motor output of the initially defined travelling mechanism based on different travel speeds in horizontal and in vertical profile tracks, while keeping the wear of the toothed wheel and the running noises low and simultaneously avoiding the provision of additional component parts, particularly because of the space requirement connected therewith, is inventively resolved in that the frictional drive wheel is comprised of an elastic material at least in the area close to its circumference and exhibits radial slots whose size and spacings from one another are dimensioned such that, taking into consideration the elasticity of the frictional drive wheel material and the difference between frictional drive wheel diameter and the pitch diameter of the toothed wheel, the slip occurring at the frictional drive wheel rolling on the profile rail during the engagement of the toothed drive wheel in the toothed rack is compensated by elastic deformation of the areas of a frictional drive wheel between neighboring slots respectively engaged with the profile rail.

In additional to its actual drive task in horizontal profile rail tracks, thus the frictional drive wheel is also assigned a support task in the area of profile rail tracks provided with toothed racks. The slip at the frictional drive wheel thereby necessarily produced due to the different circumferential speeds does not, however, lead to increased wear of the frictional drive wheel and, at the same time, to an increased power consumption in the area of vertical profile rail tracks but is nearly entirely compensated by the special structural shape of the frictional drive wheel. All disadvantages of the preferred design of the travelling mechanism with different diameters of the frictional drive wheel and of the toothed wheel pitch, desired per se because of the good exploitation of the motor output and the direct employment of the profile rails as a rolling track for the frictional drive wheel, are thus eliminated.

When—as an advantageous further development of the invention provides—the electric motor together with the drive shaft is resiliently mounted on the chassis of the travelling mechanism, the frictional drive wheel is maintained by the resilient mounting in constant engagement with the track allocated to it while supporting the toothed drive wheel connected to the frictional drive wheel as its ideal level relative to the toothed rack for minimized wear and noise.

The number and dimensions of the slots are selectable within relatively wide limits; applicable as fundamental rules therefor is that the product of the number of slots and the slot width is of approximately the same magnitude as the slip of the frictional drive wheel and that the number of slots is selected of approximately the same magnitude as the number of teeth of the toothed drive wheel. When the number and/or width of the slots is increased beyond this, the elastic slip compensation continues to be assured but the driving behavior of the frictional drive wheel given a raised (disengaged) toothed wheel is unfavorably influenced. A further dimensioning rule is that the width of the slots increases with a reduction in the elasticity of the material of the frictional drive wheel.

The invention is explained below with reference to an exemplary embodiment illustrated in the Figures on the accompanying drawing sheets; and

DETAILED DESCRIPTION

Figure 1:
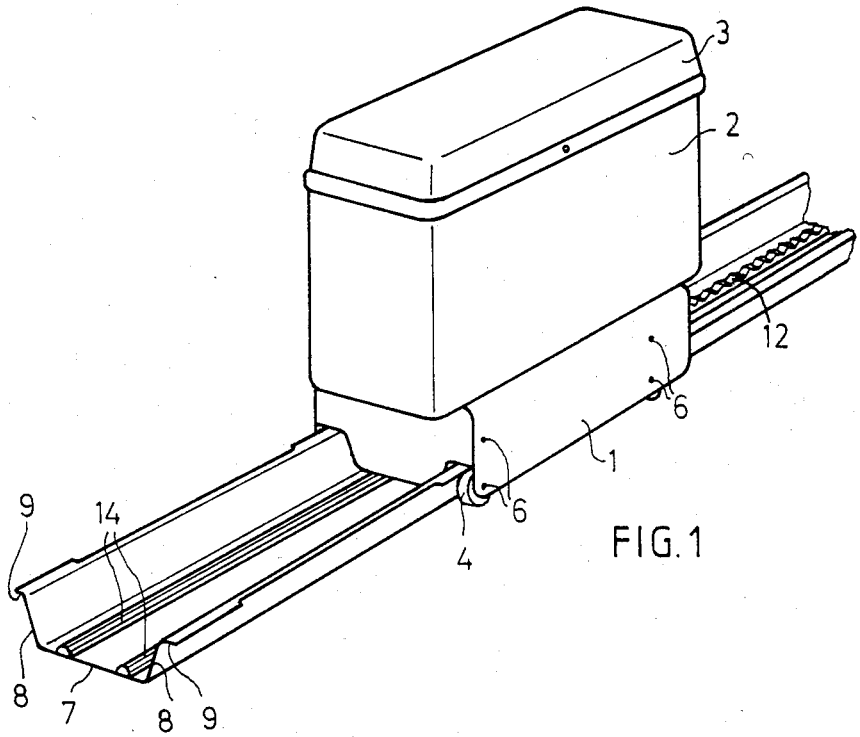
FIG. 1 shows a perspective view of a transport car in a profile rail.

As shown in FIG. 1, a travelling mechanism or drive assembly 1 of a transport car carries a container 2 closeable by means of a cover 3. The lower lateral area of the travelling mechanism 1 extends downward to such degree that the lateral travelling rollers 4 are nearly completely covered, and further travelling rollers 5 are entirely covered. This lateral area simultaneously contains the bearing points 6 of the travelling rollers 4,5.

A guide rail exhibits lateral webs 8 attaching to a center web 7, the upper ranges of said lateral webs 8 merging into flanges 9. Whereas a frictional drive wheel 10 is in rolling engagement with the center of the center web 7, the travelling rollers 4,5 are guided at the lower and respectively, upper guide faces of the flange 9.

Figure 2:
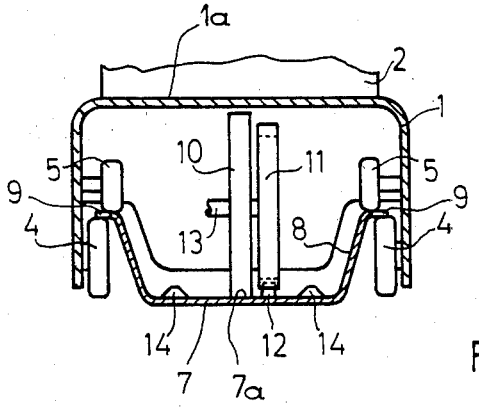
FIG. 2 shows a cross-section through the arrangement shown in FIG. 1.

As shown in FIG. 2, a frictional drive wheel 10 is rigidly disposed on a drive shaft 13 in common with a toothed wheel 11 which engages with a toothed rack 12 in sub-sections of the conveyor system departing from the horizontal, said drive shaft being driven by an electric motor (not illustrated in FIG. 2). The drive motor receives its drive energy over live rails 14 disposed on the center web 7 symmetrically relative to the frictional drive track for the drive wheel 10. The flanges 9 are cutout area-wise such that a clearance for removing and inserting the transport car arises.

Figure 3:
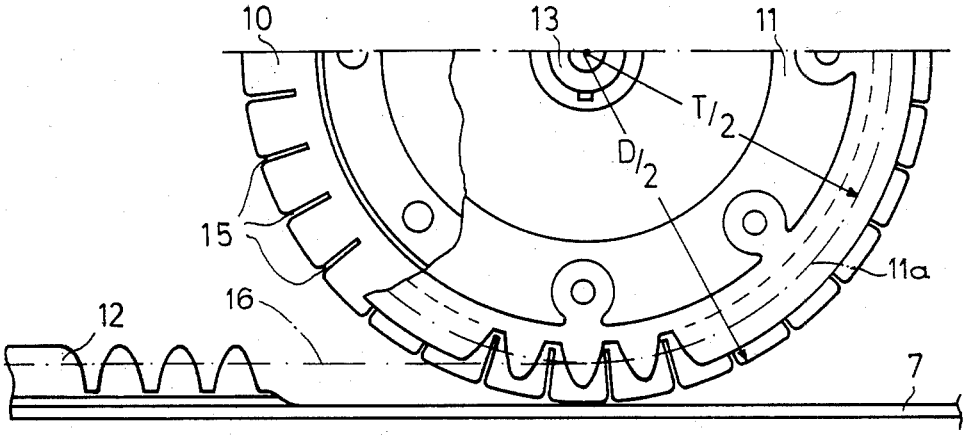
FIG. 3 is a partial somewhat diagrammatic elevational view showing the detailed design of the toothed drive wheel and of the frictional drive wheel of the transport car.

FIG. 3, in a scale magnified in comparison to that of FIGS. 1 and 2, shows a partial view, with the toothed drive wheel 11 partially broken away, and the center web 7 in longitudinal section. The drive shaft 13 is shown with the frictional drive wheel 10 and toothed drive wheel 11, respectively, secured thereto, and the center web 7 of the guide rail is shown with a section of toothed rack 12 secured thereto. The pitch diameter (T) of the toothed drive wheel is less than the diameter (D) of the frictional drive wheel 10; the toothed rack 12 is designed such that the toothed wheel 11 is situated at its ideal engagement level relative to the toothed rack 12 due to its relative position relative to the center web 7 prescribed by the frictional wheel 10, for minimum wear and noise.

Assuming an imaging scale 1:1, then the slip between the circumferential path traversed by the frictional wheel 10 given one revolution of the drive shaft 13 and the circumferential path on the pitch of the toothed wheel 11 is 44 mm. $(D-T)\cdot\pi=(118-104)\cdot\pi=44$ mm. In adaptation thereto, the slot width measured in the circumferential direction is fixed at 1.2 mm. The product of the number (33) of slots 15 and the slot width thus amounts to about 40 mm, whereby the slip exceeds this product by approximately 10%.

Figure 4:
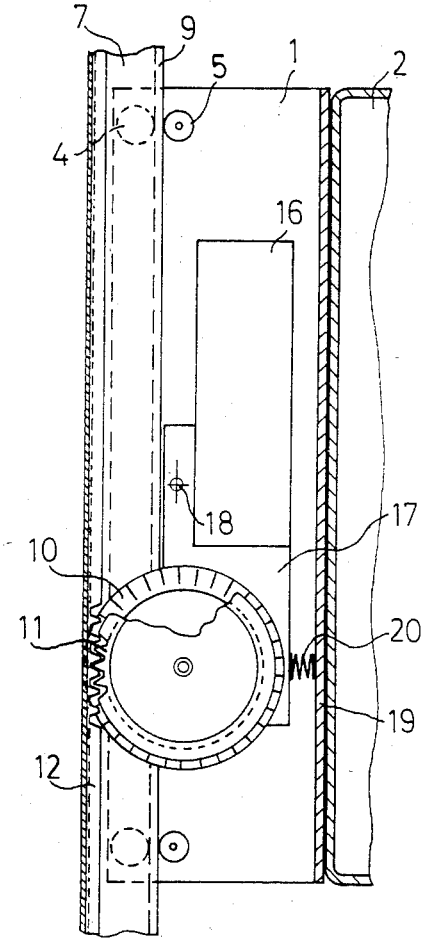
FIG. 4 is a somewhat diagrammatic view illustrating the resilient mounting of the electric motor.

On a scale reduced in comparison to that of FIG. 3, FIG. 4 schematically shows a travelling mechanism unit within a vertical rail section. It can be derived from the illustration that the travelling rollers 4, 5 roll at respective sides of the flange 9 of the guide rail. The frictional drive wheel 10 and the toothed wheel 11 are rigidly disposed on the drive shaft 13 which in turn represents the output of a transmission unit 17 that is flange mounted to the travelling mechanism motor 16. Achieved as a result of the pivotable suspension of the drive unit formed of the transmission unit 17 and the motor 16 by means of the pivot axis 18 and by means of the compression spring 20 supported against the housing wall 19 is that the frictional drive wheel 10 is pressed against the center web 7 and, thus, the toothed wheel 11 is brought into an optimum relative position with respect to the toothed rack 12. Given a weight of the travelling mechanism unit as shown in FIG. 4 of about 100N, the spring power can, for example, amount to 50N in the arrangement of FIG. 4.

It will be apparent that many modifications and variations may be made without departing from the scope of the teachings and consepts of the present invention.

SUPPLEMENTARY DISCUSSION

It will be understood that in FIG. 2, the toothed rack 12 may be extending vertically, and that a set of the rollers 4,5 may be at each end of the self-propelled carriage 1. The electric motor and the drive shaft 13 may be intermediate the sets of rollers 4,5 so that chassis part 1*a* is held in fixed parallel relationship to central web 7. The resilient mounting of the motor together with shaft 13 resliently urges these parts away from chassis part 1*a* and toward the central web 7. In FIG. 2, the engagement of the slotted periphery of friction roller 10 with its track 7*a* limits the movement of shaft 13 toward the center web 7 and serves to hold the pitch circle 11*a* (FIG. 3) of the toothed wheel 11 at a level 16 above the surface of the central web 7 as indicated in FIG. 3, as the toothed wheel 11 rolls along track 12, so as to maintain the optimum play for minimized wear and/or noise.

We claim as our invention:

1. A transport car drive assembly of a transport car for the conveying of files and/or transport goods having similar dimensions or weight contained in a transport car container, said drive assembly comprising a transport car drive mechanism for propelling a transport car associated therewith and running on horizontal and, in sections, vertical profile rail tracks, said transport car drive mechanism including a frictional wheel having a track-engaging periphery defining an external diameter of the frictional wheel and having rolling frictional engagement with horizontal and vertical track surfaces during drive of an associated transport car along horizontal and vertical profile rail tracks, said transport car drive mechanism further including a toothed wheel for rolling engagement with vertically disposed toothed racks of vertical profile rail tracks for controlling the rate of movement of an associated transport car along such vertical profile rail tracks, said transport car drive mechanism also including an electric motor providing the motive power therefor and having a drive shaft driven thereby, said drive shaft carrying the frictional wheel and the toothed wheel for joint rotation therewith to effect the transport of an associated transport car, said toothed wheel having a pitch diameter smaller than the external diameter of the track-engaging periphery of the frictional wheel, the frictional wheel having radial slots and being composed of an elastic material at least in regions thereof between the slots and close to the track-engaging periphery, the dimensions of the radial slots and the spacing of the slots from one another being such that, taking account of the elasticity of the elastic material of the frictional wheel and the difference between the external diameter of the track-engaging periphery of the frictional wheel and the pitch diameter of the toothed wheel, the slip differential of the frictional wheel due to such difference in diameters during rolling engagement of the toothed wheel in a vertically disposed toothed rack is compensated by elastic deformation of the elastic material at the regions of the frictional wheel between neighboring slots.

2. A transport car drive assembly according to claim 1, wherein the product of the number of said radial slots and the slot width is approximately equal to the magnitude of the slip differential of the frictional wheel.

3. A transport car drive assembly according to claim 1, wherein the electric motor is resiliently mounted in the transport car drive assembly such that the frictional wheel and the toothed wheel are resiliently urged respectively toward a vertical track surface and toward a vertically disposed toothed rack during movement of an associated transport car along a vertical profile rail track.

4. A transport car drive assembly according to claim 1, with the electric motor together with said drive shaft being resiliently mounted to maintain said frictional wheel in pressure engagement with a vertical track surface while the toothed wheel is held by such pressure engagement at a level for minimized wear and noise during its rolling engagement with a vertically disposed toothed rack.

5. A transport car assembly for horizontal and vertical travel comprising a self-propelled transport carriage having a container for conveying files and/or transport goods having similar dimensions or similar weight, said transport carriage having a drive mechanism including a frictional drive wheel and a toothed drive wheel for driving said transport carriage along horizontal and, in sections, vertical profile rail tracks, said drive mechanism further comprising an electric motor having drive shaft means carrying the frictional drive wheel and the toothed drive wheel thereon for effecting joint rotation of the frictional drive wheel and the toothed drive wheel, the toothed drive wheel being in rolling engagement with a toothed rack during movement of the transport carriage along vertical profile rail tracks, said frictional wheel having a track-engaging periphery defining an external diameter thereof and having rolling frictional engage-ment with horizontal and vertical track surfaces respectively during drive of the transport carriage along horizontal and vertical profile rail tracks, said toothed drive wheel having a pitch diameter smaller than the external diameter of the track-engaging periphery of the frictional drive wheel so as to define a required slip differential of the frictional drive wheel rela-tive to the movement of the transport carriage during rolling engagement of the toothed drive wheel with a toothed rack, the frictional drive wheel having radial slots and being composed of an elastic material at least in regions thereof between the slots and close to the track-engaging periphery, the dimensions of the radial slots and the spacing of the slots from one another being such that, taking account of the elasticity of the elastic material of the frictional drive wheel and the difference between the external diameter of the track-engaging periphery of the frictional drive wheel and the pitch diameter of the toothed drive wheel, the slip differential of the frictional drive wheel is compensated by elastic deformation of the elastic material at the regions of the frictional drive wheel between neighboring slots.

* * * * *